US005465642A

United States Patent [19]

Goto

[11] Patent Number: 5,465,642

[45] Date of Patent: Nov. 14, 1995

[54] NECK STRAIGHTENER FOR STRINGED INSTRUMENT

[75] Inventor: Masaki Goto, Gunma, Japan

[73] Assignee: Gotoh Gut Yugen Kaisha, Gunma, Japan

[21] Appl. No.: 361,221

[22] Filed: Dec. 21, 1994

[30] Foreign Application Priority Data

Dec. 30, 1993 [JP] Japan ..... 5-355240

[51] Int. Cl.[6] ..... G10D 3/00

[52] U.S. Cl. ..... 84/293

[58] Field of Search ..... 84/293

[56] References Cited

U.S. PATENT DOCUMENTS

| | | | |
|---|---|---|---|
| 4,235,145 | 11/1980 | Adams, Jr. | 84/293 |
| 4,308,780 | 1/1982 | Boucher | 84/293 |
| 4,508,003 | 4/1985 | Smakula | 84/293 |

FOREIGN PATENT DOCUMENTS

| | | |
|---|---|---|
| 54-94220 | 7/1979 | Japan . |
| 55-71390 | 5/1980 | Japan . |
| 56-5185 | 1/1981 | Japan . |
| 56-14554 | 4/1981 | Japan . |
| 56-14553 | 4/1981 | Japan . |
| 58-38192 | 3/1983 | Japan . |
| 62-146195 | 9/1987 | Japan . |
| 1-234898 | 9/1989 | Japan . |
| 3-33488 | 4/1991 | Japan . |
| 210169 | 7/1993 | Taiwan . |

*Primary Examiner*—Patrick J. Stanzione
*Attorney, Agent, or Firm*—Wenderoth, Lind & Ponack

[57] ABSTRACT

A reinforcing member with a U-shaped cross section and an actuating rod are joined and assembled in parallel. A base end of the reinforcing member is fixed to a support, and an end part of the actuating rod is fitted to a threaded sleeve which is fitted to be freely rotatable to the support. Thus, the length of the actuating rod relative to the reinforcing member can be increased and decreased by rotation of the threaded sleeve. The actuating rod is provided with a pushing block having a pushing-up surface which comes into contact with the reinforcing member. A partly cutaway part, aligned with the pushing block and formed by a continuously arc-shaped edge, is provided on each side wall of the reinforcing member.

9 Claims, 12 Drawing Sheets

NECK STRAIGHTENER FOR STRINGED INSTRUMENT

BACKGROUND OF THE INVENTION

The present invention relates to a neck straightener for a stringed instrument such as a guitar to be used in a neck part of a stringed instrument and, more particularly, a neck straightener which is formed by assembling two rod members in a parallel arrangement.

Strings of a stringed instrument such as a guitar are extended between a bridge device provided on a body and pegs provided in a head of a neck part of the instrument, and therefore the neck part is warped relative to the strings in a concave form by a tension force of the strings, thereby causing an upward warp. The neck part of this type of a stringed instrument also is warped relative to the strings in accordance with a type of wood material which forms the neck part and a degree of drying thereof, thereby causing a downward warp. In a case of the upward warp, it is difficult to hold the strings at respective frets of a finger plate and, in a case of the downward warp, the strings come into contact with the frets and the stringed instrument cannot be played normally. For this reason, a conventional stringed instrument is provided with a neck straightener in the neck part to straighten the neck part which otherwise would be warped.

A known neck straightener as described above is formed by a truss rod which is inserted into the neck of the stringed instrument, e.g. as disclosed in Japanese Utility Model Application Disclosure Gazette No. HEI. 3-33488. This type of neck straightener includes a problem that it is necessary to form a curved groove in the neck part and the straightening force is weak. Therefore a neck straightener comprising two rod members, which are assembled in parallel, is used in a stringed instrument with a larger number of strings each having a strong tension, such as an electric guitar, and this type of neck straightener is disclosed, for example, in Japanese Patent Application Disclosure Gazette No. HEI. 1-234898. Such neck straightener using the two rod members is advantageous in that one of the two rod members is curved in a direction opposite to the direction of warp of the neck part by increasing or decreasing the length of the second rod member with reference to the first rod member, and a repulsive force produced by such curving is used as a straightening force for warp of the neck part. Therefore, the rigidity of the entire neck straightener can be increased and the repulsive force can be increased as well. The repulsive force is obtained by curving one of two rod members and therefore a stress concentration point which acts on the neck part is the center of the curve of the curved rod member.

However, the strings which apply tension to the neck part are extended between the bridge device and the pegs. Thus, the center of warp which occurs on the neck part is deviated from the center of the neck part to the body side of the instrument and is presumed as being adjacent the border between a heel portion and a straight portion, in view of a difference of strength between the neck part and the body part and the difference of strength between the heel portion which is the base at the body side of the neck part and the straight portion which is extended from the heel portion.

In the case of a concave warp of the neck part with reference to the strings due to the tension of the strings, there is a problem that the stress concentration point, that is the center of a straightening force, is located at a point deviated from the center of warp of the neck part toward the head side, and therefore the neck part cannot be accurately straightened.

In the case of a convex warp of the neck part with reference to the strings, such warp is dependent on the type of wood material or a degree of drying thereof. Therefore, though it is generally difficult to specify the center of warp, it is generally presumed that the center of such warp exists around the center of the straight portion of the neck part and coincides with the center of straightening by the straightener in most cases.

In the case of the concave warp, however, the center of warp may deviate to the head side of the neck part. In such case, the center position of convex warp greatly differs from that of the concave warp. The center of the convex warp may be estimated by a stringed instrument manufacturer during manufacturing processes and such estimation is done taking the type of wood material and the degree of drying into account. Accordingly, there is still a problem that, if the center of convex warp of the neck part substantially differs from the center or concentration point of a straightening force of the neck straightener, accurate straightening cannot be carried out.

SUMMARY OF THE INVENTION

An object of the present invention is to provide a neck straightener for a stringed instrument to be used to straighten a neck part of the stringed instrument by concentrating a stress at a center of warp of the neck part.

Another object of the present invention is to provide a neck straightener for a stringed instrument capable of preventing a reinforcing member from being bent by a large stress concentrated and applied to the center of warp of the neck part of the stringed instrument.

In the neck straightener according to the present invention, two rod members to be accommodated in an elongated groove of the neck part include a resilient reinforcing member, having a high degree of rigidity and to be located at a finger plate side to come into contact with a ceiling or the finger plate of the groove, and a resilient actuating rod, having a high degree of rigidity and assembled in parallel with the reinforcing member to come into contact with the bottom of the groove. The resilient actuating rod is provided at an end part thereof with means for adjusting the length thereof of the actuating rod and with a pushing block which is located at a position to correspond to a center of warp of the neck part.

The reinforcing member and the actuating rod which is accommodated in a channel of the reinforcing member are assembled in parallel so as to be in light contact with each other and are firmly joined together at their extreme first ends thereof, while other ends thereof are supported by a supporting member which is to be fixed stationarily in the groove. The supporting member supports the adjusting means such as, for example, a threaded sleeve, which receives the end part of the actuating rod. The threaded sleeve meshes with a threaded part formed at the end part of the actuating rod. The threaded sleeve is provided with, for example, a hexagonal wrench hole enabling clockwise and counterclockwise rotation thereof by engagement of a wrench bar in such hexagonal wrench hole, thus permitting increasing or decreasing the length of the actuating rod relative to the reinforcing member.

The pushing block is to be arranged to correspond to the center of warp in case of concave warp of the neck part, that is at a position deviated from the center of the neck part toward the heel part, and has a first pushing surface such as, for example, a pushing-up surface which comes into contact with the reinforcing member. The pushing block further can be provided with a second pushing surface such as, for example, a pushing-down surface which is to come into contact with the bottom of the groove. In such case, a precondition is that the center of warp in the case of convex warp of the neck part is at a location deviated to the heel part from the center of the neck part.

When the center of convex warp of the neck part is located at a position deviated toward the head side from the center of the neck part, there is a certain considerable distance between the center of concave warp and the center of convex warp of the neck part. It is preferable to provide a second pushing block on the actuating rod, the second pushing block being arranged at a position which is deemed as the center of convex warp and having the pushing-down surface which is to come into contact with the bottom of the groove. When two pushing blocks are arranged in parallel on the actuating rod, a pushing-down surface of the first pushing block is unnecessary and a pushing-up surface need not be formed on the second pushing block.

The reinforcing member has a U-shaped cross sectional configuration and is provided with a partly cutaway part formed with a continuously arc-shaped edge on each of its side walls. The pushing block or the pushing blocks are arranged in alignment with such partly cutaway parts.

A hard block is installed in the reinforcing member between the side walls thereof and the actuating rod.

DETAILED DESCRIPTION OF THE PREFERRED EMBODIMENTS OF THE INVENTION

Figure 1:
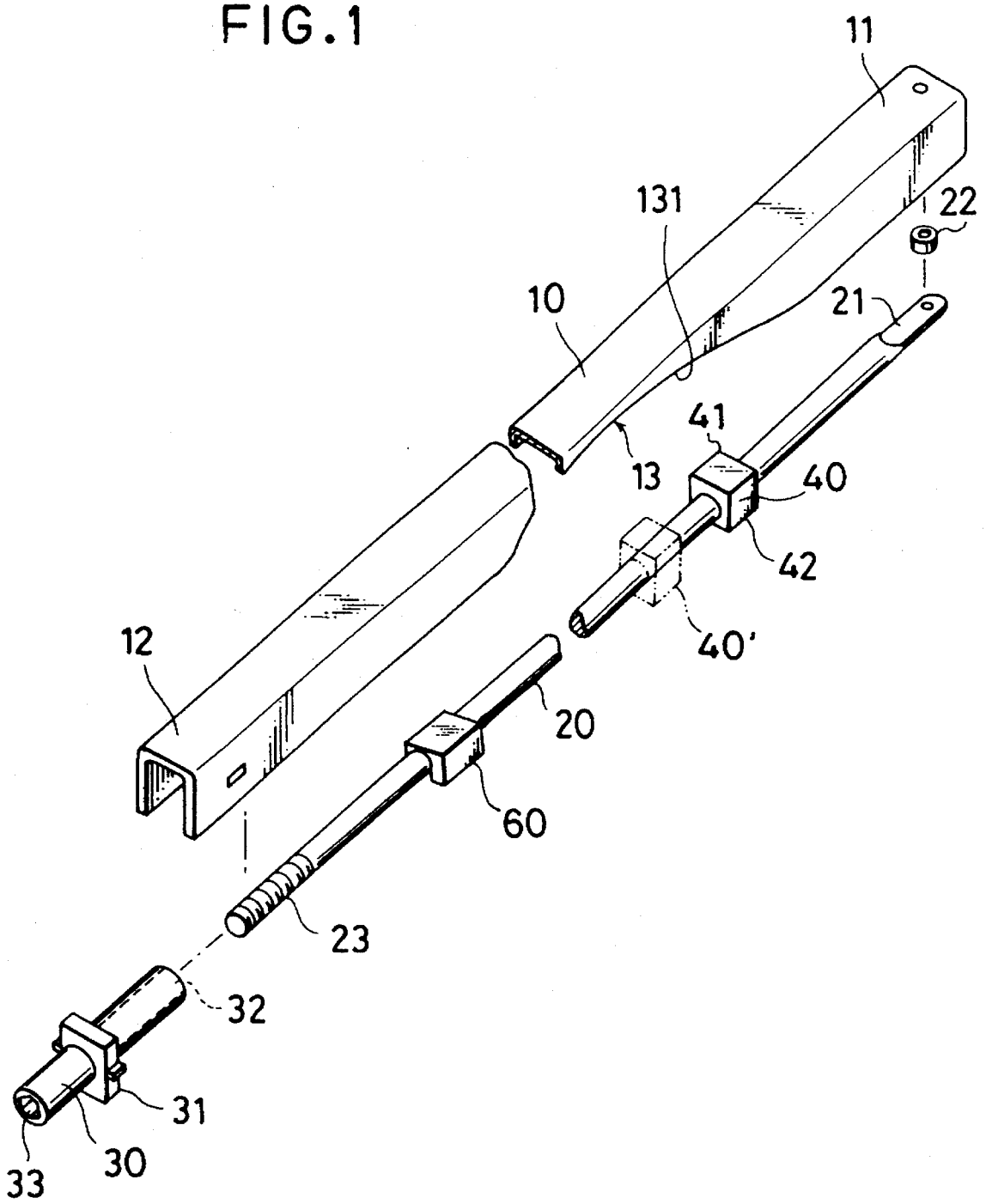
FIG. 1 is a disassembled perspective view of a neck straightener according to the present invention.
Figure 2:
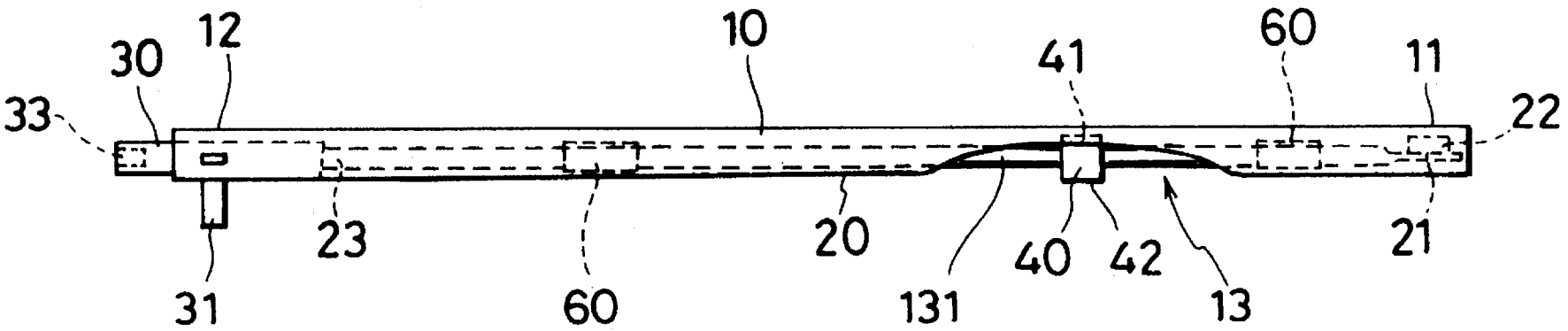
FIG. 2 is a side view of the neck straightener.

The neck straightener according to the present invention has, as shown in FIGS. 1 and 2, a resilient reinforcing member 10 having a high degree of rigidity, a resilient actuating rod 20 having a high degree of rigidity and assembled in parallel arrangement with the reinforcing member 10, adjusting means, e.g. a threaded sleeve 30, provided at one end of the actuating rod 20, and a pushing block 40 provided on the actuating rod 20.

Figure 3:
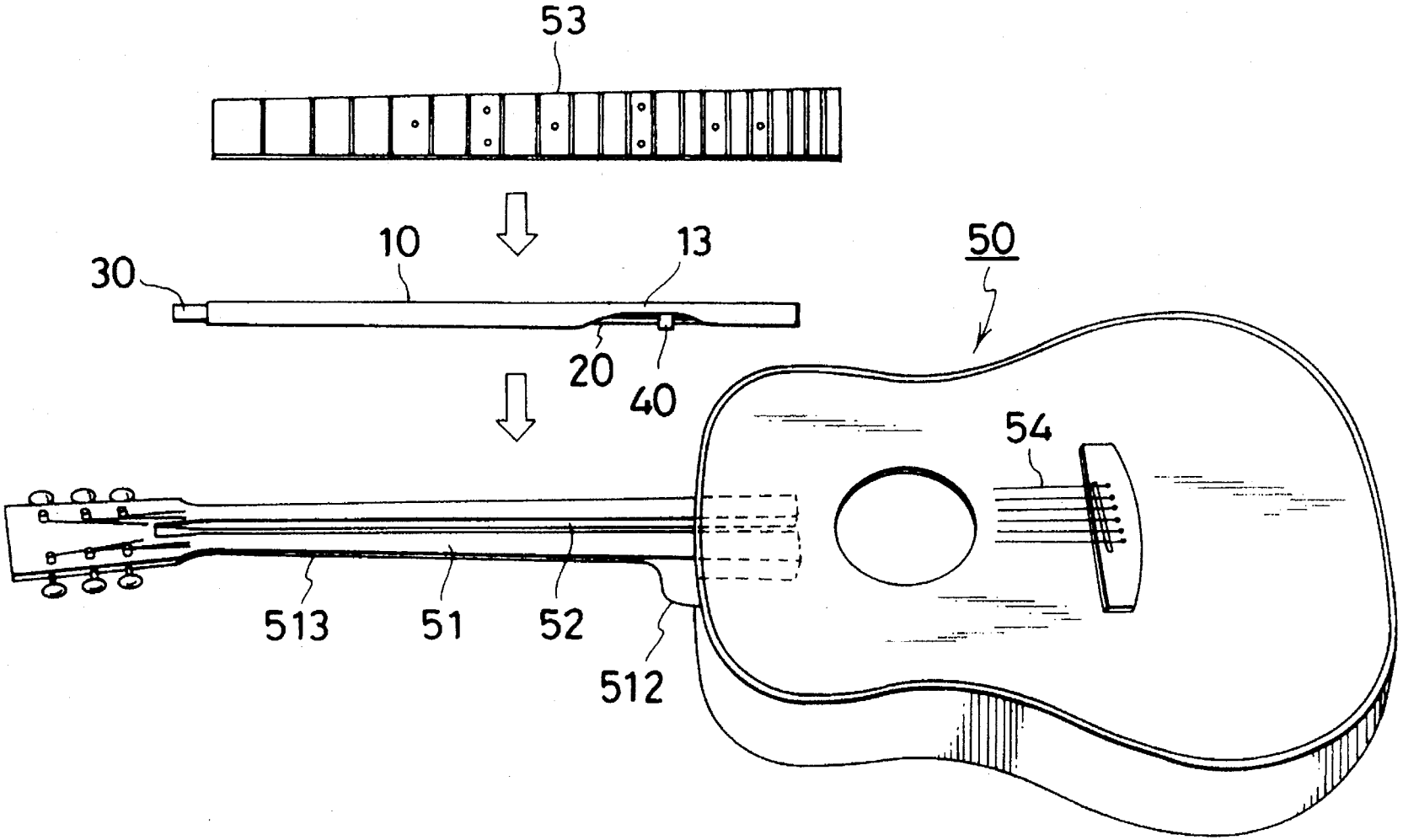
FIG. 3 is a perspective view of a guitar incorporating the neck straightener.
Figure 4:
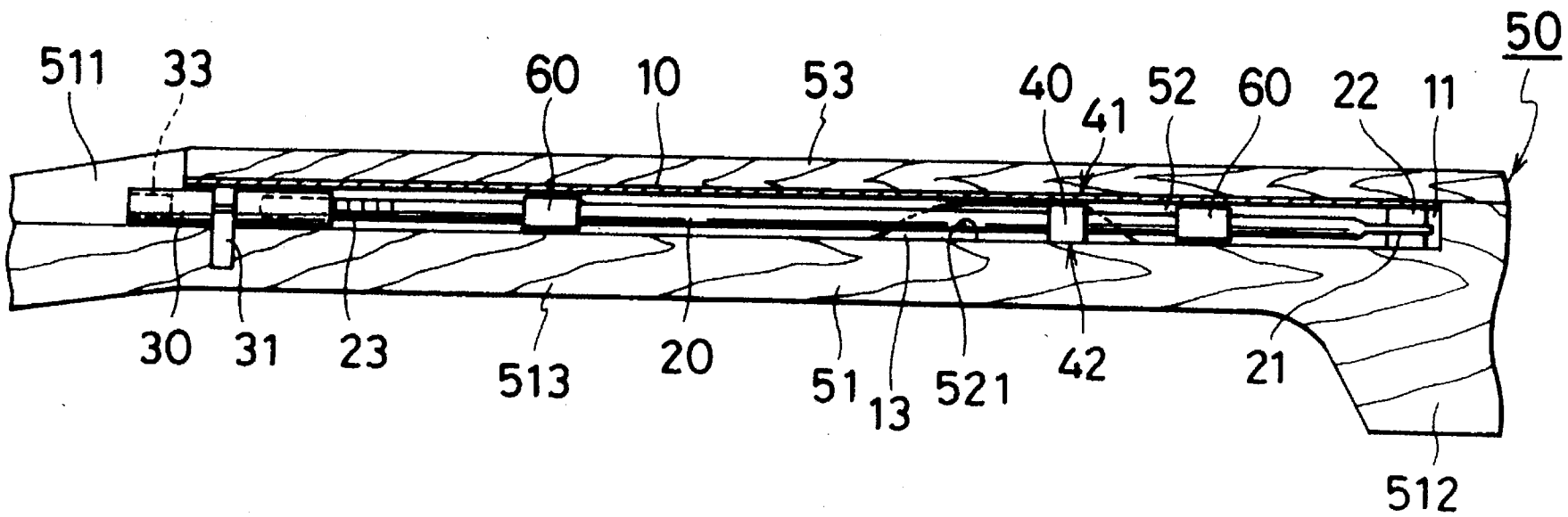
FIG. 4 is a vertical sectional side view of a neck part of the guitar.

The reinforcing member 10 and the actuating rod 20 are firmly joined at extreme first ends 11 and 21 thereof by coupling means such as, for example, a rivet 22, and the other second end 12 of the reinforcing member 10 is fixed to a support member 31 of the threaded sleeve 30. The threaded sleeve 30 has therein threaded hole 32 extending in the axial direction thereof and is rotatably supported by the support member 31. The support member 31 is fixable at a bottom 521 of an elongated groove 52 provided in a stringed instrument, such as for example a guitar 50, as shown in FIG. 4. The end part of the actuating rod 20 is meshed into the threaded hole 32 of the threaded sleeve 30 and, for this purpose, the end part of the actuating rod 20 is threaded. The pushing block 40 is provided with a pushing-up surface 41 which comes into contact with the reinforcing member 10 and a pushing-down surface 42 which comes into contact with the bottom 521 of the groove 52. The neck straightener according to the present invention is accommodated in the elongate groove 52 formed in the neck part 51 of the guitar 50, as shown in FIGS. 3 and 4, and a finger plate 53 is bonded over the groove 52, the groove thus being closed. The threaded sleeve 30 of the straightener is provided with operating means such as, for example, a wrench hole 33 for fitting a hexagonal wrench, the wrench hole 33 being exposed in an empty space 511 formed in the neck part 51 so as to permit operation from the exterior thereof.

The pushing block 40 is arranged at the center of warp of the neck part 51 which is expected to advance, for example, adjacent the border between heel part 512 and straight part 513 of the neck part 51, when is use the neck part 51 is warped to be upwardly concave relative to the strings 54, and at a position to be presumed in view of the specific conditions of the neck part 51 in the case of the neck part 51 is warped to be downwardly convex relative to the strings 54.

In the illustrated embodiment, the reinforcing member 10 is made of a steel channel member having a U-shaped cross section, and the actuating rod 20 is made of a steel rod. The adjusting means alternatively can be a structure using a worm gear, as disclosed in Japanese Utility Model Application Disclosure Gazette No. SHO. 54-94220, or a structure using a union nut, as disclosed in Japanese Patent Application Disclosure Gazette No. HEI. 1-234898.

Figure 9:
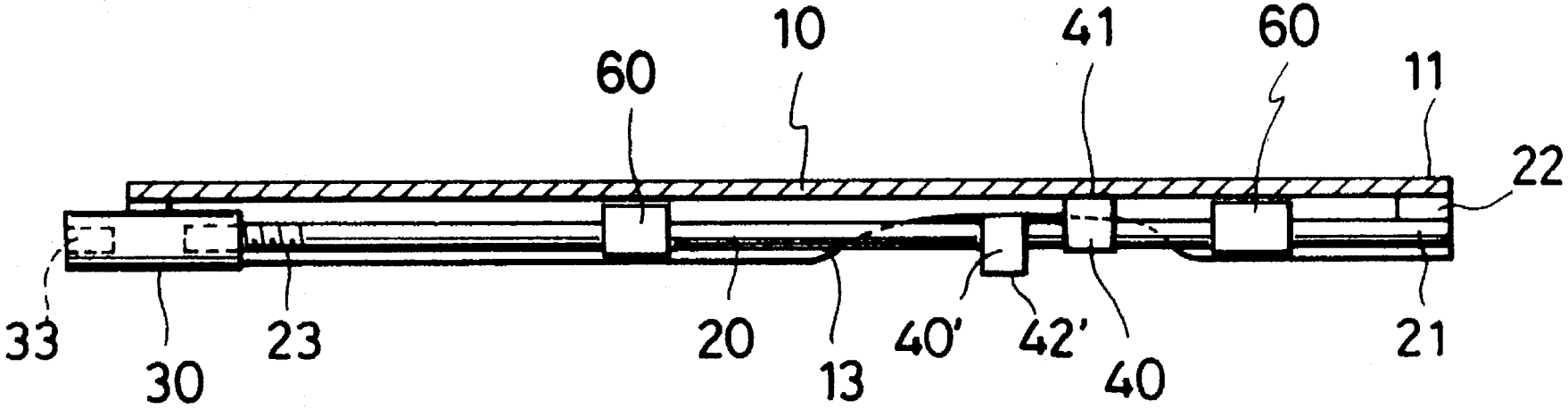
FIG. 9 is a side view, partially in section, of another embodiment of the neck straightener.

Only one pushing block 40 to be provided as shown in FIG. 2, when the center of convex warp of the neck part 51 is not so far from the center of concaved warp. However, as described above, there are diversified types of causes of convex warp of the neck part 51, and therefore the center of concave warp may be spaced from the center of convex warp in some cases. In such case, as shown in FIG. 9, it is preferable to provide two pushing blocks 40 and 40' on the actuating rod 20, one block 40 for concave warp and the other block 40' for the convex warp. The pushing block 40 for concave warp is arranged at a position adjacent the border between the heel part 512 and the straight part 513 and only the pushing-up surface 41 is provided on the pushing block 40. The pushing block 40' is arranged at a position corresponding to the center of expected convex warp, as described above, and only the pushing-down surface 42' is provided on the pushing block 40'. The pushing-down surface 42 of the pushing block 40 need not be provided if the center of convex warp of the neck part 51 corresponds to the center of the neck part 51. In other words, the reason in this case is that the center of curve due to the increase of length of the actuating rod 20 is expected to approximately correspond to the center of the neck part 51, and therefore the center of curve of the actuating rod 20 acts directly as the stress concentration point for straightening.

Figure 10:
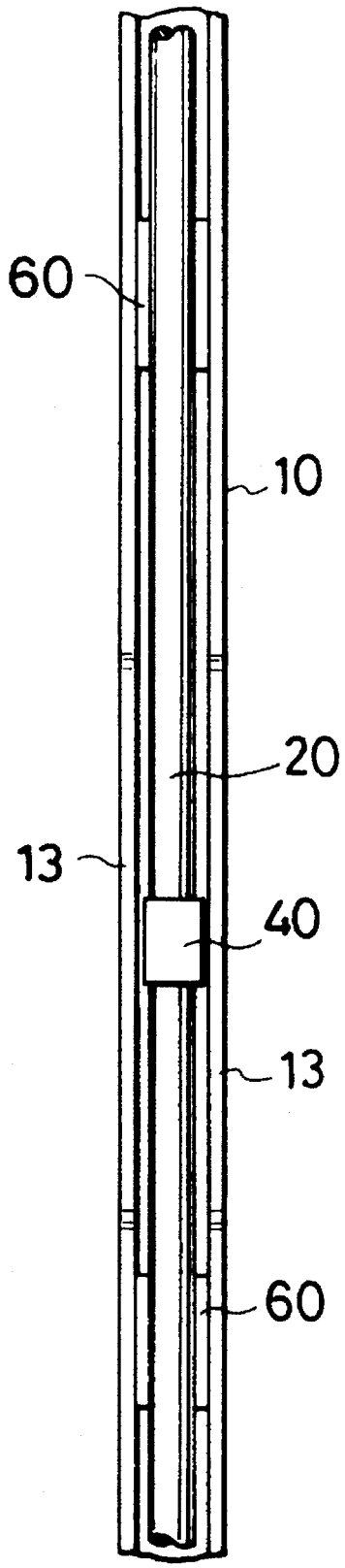
FIG. 10 is a bottom view of an important part of the neck straightener.
Figure 11:
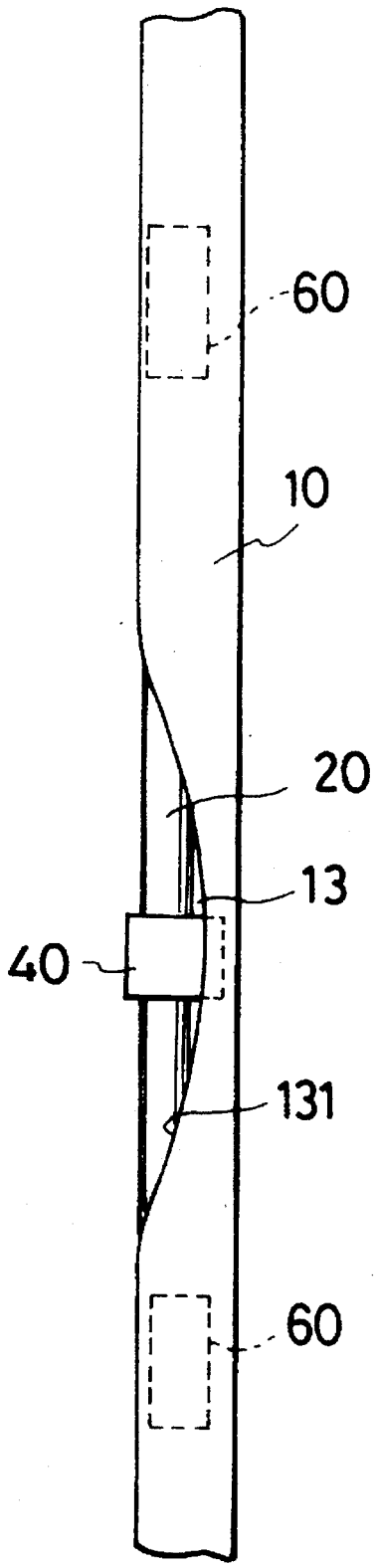
FIG. 11 is a side view of the important part of the neck straightener shown in FIG. 10.

The reinforcing member 10 has a partly cutaway part 13 aligned with and having a length accommodating and including the pushing block 40, as shown in FIGS. 10 and 11, and the edge of the partly cutaway part 13 is formed as a continuously arc-shaped edge 131. In the case that the second pushing block 40' is used simultaneously, the partly cutaway part 13 is made of a length aligned with and including both the pushing block 40 and the second pushing block 40'.

The position of the partly cutaway part 13 is determined in accordance with the position of the pushing block 40 or the positions of two pushing blocks 40 and 40' and varies in correlation with the shape and material of the neck part 51 and the stress resistance of the heel part 512 and the straight part 513. Therefore, the position of the partly cutaway part 13 can be determined as a function of the factors influencing warp of the neck part 51. In the case that the straight part 513 of the neck part 51 is warped, for example, at a position deviated to the head side, the position of the partly cutaway part 13 is usually set between the third fret and the seventh fret with the fifth fret as the center. In the case that the center of warp is located near the heel part 512 as described above, the partly cutaway part 13 is set at a position between the eighth fret and the eleventh fret or formed nearby the fifteenth fret, depending on the particular instrument. Physical factors such as the length, size and depth of the partly cutaway part 13 differ with the thickness of the reinforcing member 10 and the type of stringed instrument. Therefore, such factors can be determined individually for respective modes.

Figure 12:
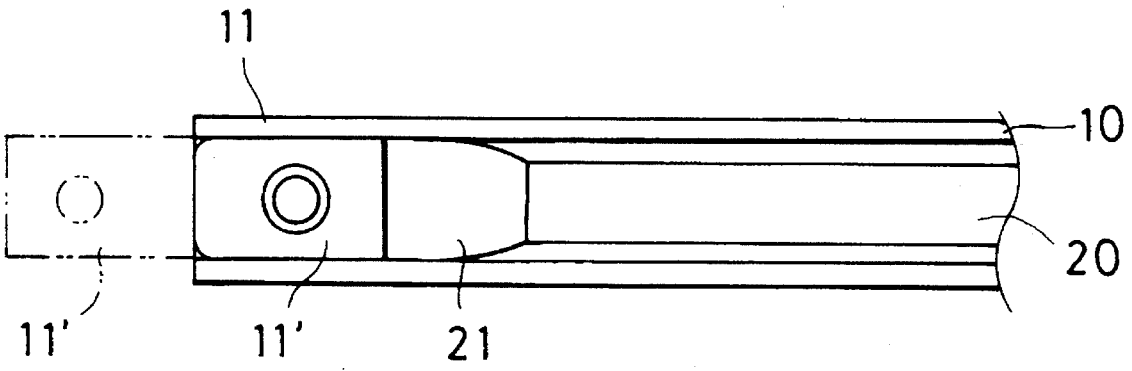
FIG. 12 is a bottom view of an end part of another embodiment of the neck straightener.
Figure 13:
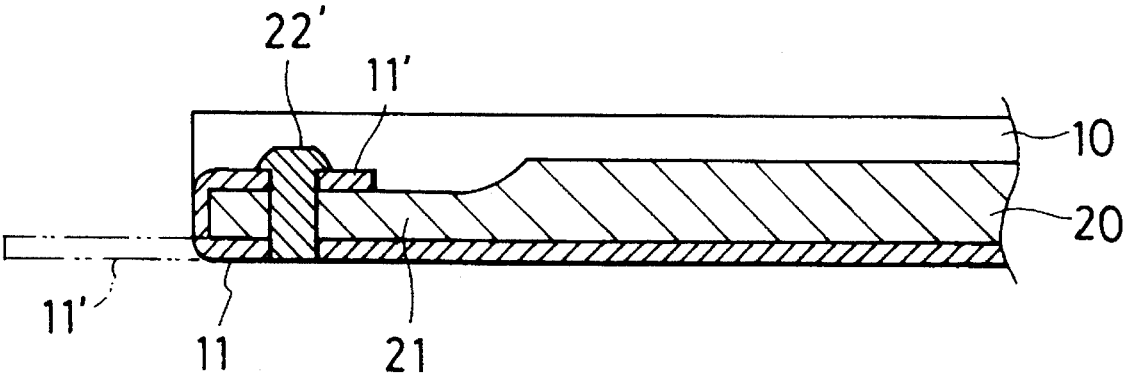
FIG. 13 is a vertical sectional side view of the neck straightener shown in FIG. 12.

The extreme ends 11 and 21 of the reinforcing member 10 and the actuating rod 20 can be joined by spot welding. In such case, it is preferable to make the extreme end of the reinforcing member 10 as a protrusion part 11' as shown by broken lines in FIGS. 12 and 13 so as to protrude from the extreme end 21 of the actuating rod 20, to fold protrusion part 11' to overlap with the extreme end 21 of the actuating rod 20, and then to spot-weld the end 11 in contact with the extreme end 21 of the actuating rod 20 and the protrusion part 11' of the reinforcing member 10 to the extreme end 21 of the actuating rod 20, as shown by solid lines in FIGS. 12 and 13. Thus, the extreme end 21 of the actuating rod and the extreme end 11 of the reinforcing member can be prevented from being separated due to a strong depressing force applied by the pushing block 40. In the case that the extreme end 21 of the actuating rod and the extreme end 11 of the reinforcing member are thus coupled by welding means, coupling of such members can be further strengthened by also welding to a pin 22' provided for coupling in advance, as shown in FIGS. 12 and 13.

The neck straightener according to the present invention is usually such that the opening side of the reinforcing member 10 is made to contact with the bottom 521 of the groove 52 and is accommodated in the groove 52 as shown in FIGS. 3 and 4. In the case that the neck part 51 is downwardly warped from the initial position, e.g. due to the nature of the wood material, the reinforcing member 10 can be accommodated in the groove 52 with its opening facing upwardly, as shown in FIG. 13, so that the opening of the groove 52 and the opening of the reinforcing member 10 face in the same direction. If so, it is advantageous that the reinforcing member 10 wholly contacts the bottom 521 of the groove 52 such that straightening effect of the downward warp will be large.

A hard block 60 is provided in the channel of the reinforcing member 10 as shown in FIGS. 1 and 10, so as to maintain a specified clearance between the actuating rod 20 and the side walls of the reinforcing member 10. Thereby, the actuating rod 20 is prevented from being deformed laterally and its axial position is maintained between such side walls.

Figure 5:
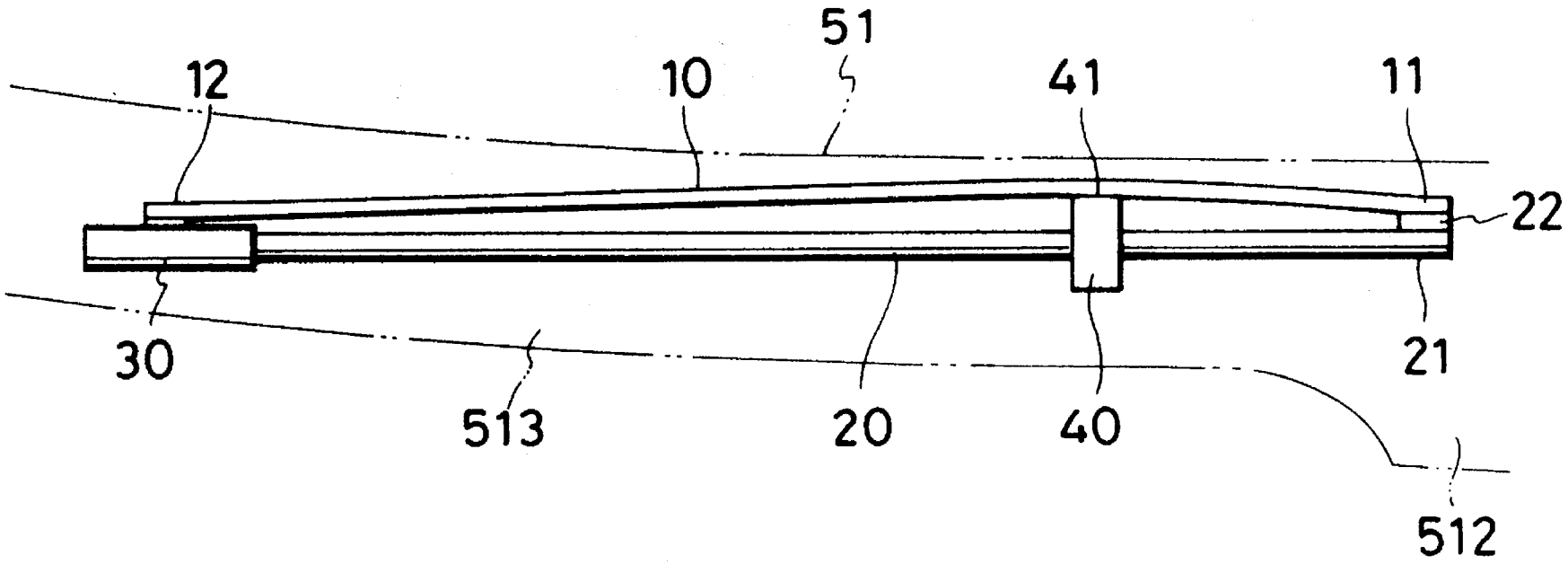
FIG. 5 is a side view of the neck straightener according to the present invention when the neck part has a concave warp.
Figure 6:
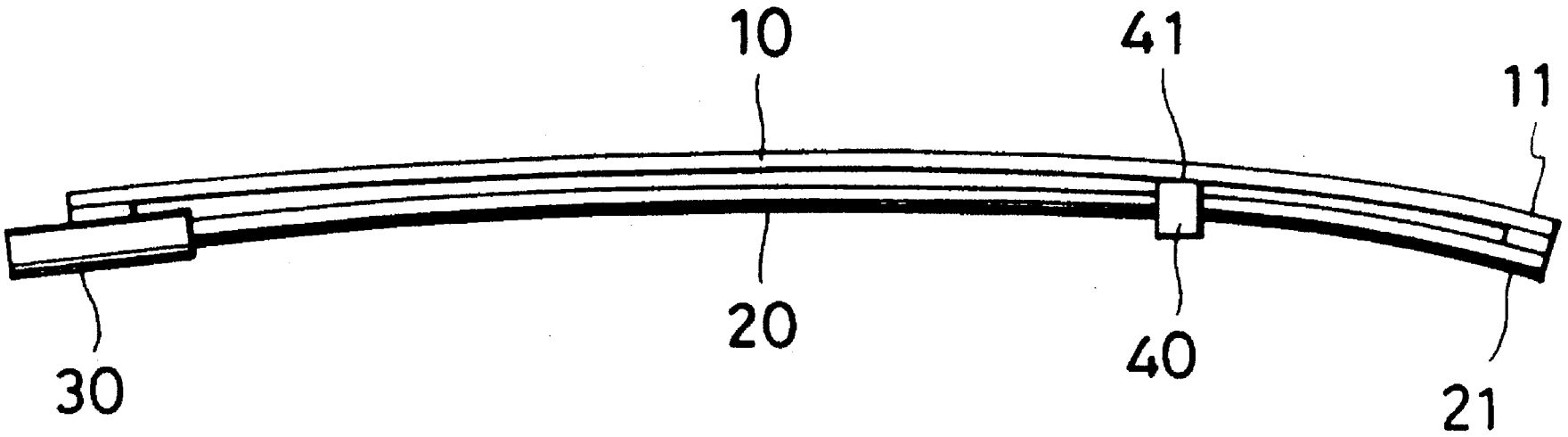
FIG. 6 is a side view illustrating the operation of the neck straightener shown in FIG. 5.

As described above, the neck straightener according to the present invention includes the pushing block 40 that is located at a position corresponding to the center of warp of the neck part 51 on the actuating rod 20 that is parallel to the reinforcing member 10. Therefore, when the neck part 51 is warped to be concave as shown by broken lines in FIG. 5, the threaded sleeve 30 is rotated to decrease the length of the actuating rod 20 relative to the reinforcing member 10. In such construction, the end of the reinforcing member 10 is pulled as much as a decrease of the length of the actuating rod 20 in a direction opposite to the direction of warping of the neck part 51, thus straightening the neck part 51. In such case, assuming that the neck straightener is in a free space, the straightener is curved as shown in FIG. 6 and the pushing block 40 forms the stress concentration point. Accordingly, assuming that the neck straightener is accommodated in the neck part 51, a strong straightening force must be applied to the neck part 51 at the position of the pushing block 40. Accordingly, if the position of the pushing block 40 is determined to be near by the heel part 512 so as to correspond to the center of warp of the neck part 51, the neck part 51 is reformed at the center of warp.

Figure 7:
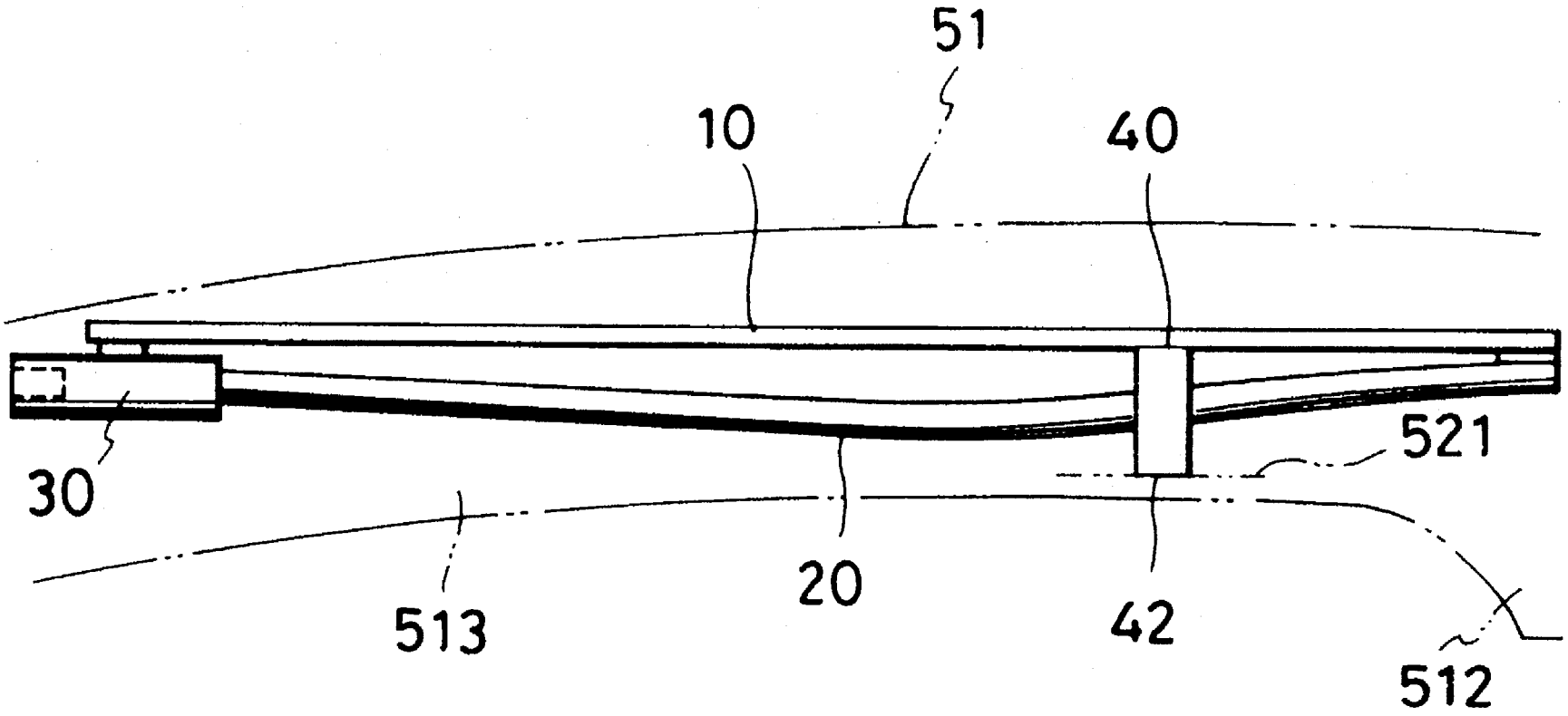
FIG. 7 is a side view of the neck part with a convex warp.
Figure 8:
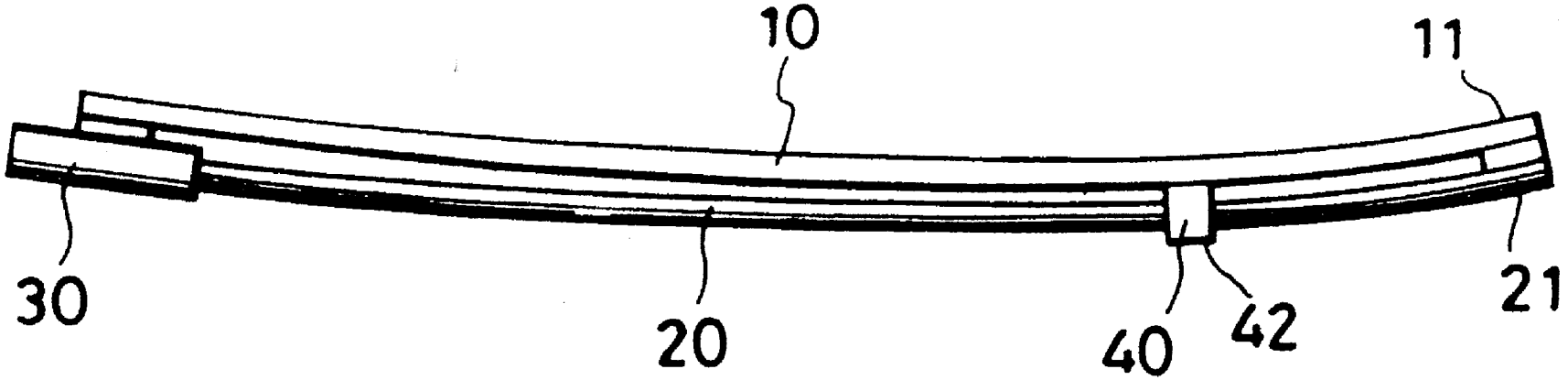
FIG. 8 is a rough side view illustrating operation of the neck straightener shown in FIG. 7.

Operation is similar in the case that the neck part 51 is warped to be convex relative to the strings 54, as shown by broken lines in FIG. 7. In such case, the extreme end of the reinforcing member 10 is pushed up in a direction opposite to the direction of warp of the neck part 51 to produce the straightening force by increasing the length of the actuating rod 20 relative to the reinforcing member 10. If the length of the actuating rod 20 is increased, if the neck straightener is positioned and held in a free space, the neck straightener is curved to absorb the increase in length of the actuating rod 20 as shown in FIG. 8, and therefore the neck part 51 can be straightened by a repulsive force thus obtained. In such case, the pushing block 40 comes into contact with the bottom of the groove 52 and forms the stress concentration point. Therefore, when only one pushing block 40 is provided as shown in FIG. 2, a depressing force in a direction opposite to the center of warp of concave warp is strongly applied in the case of convex warp of the neck part 51.

When two pushing blocks 40 and 40' are arranged in parallel so that such pushing blocks serve in response to concave warp and convex warp, respectively, as shown in FIG. 9, the stress concentration point differs with the type of warp. The pushing block 40 and the second pushing block 40' serve to concentrate the depressing force to the neck part 51 and therefore a repulsive force of the pushing blocks 40 and/or 40' is concentrated to the reinforcing member 10, and a part of the reinforcing member 10 corresponding to the positions of arrangement of the pushing blocks 40 and 40' may be bent. However, this repulsive force is dispersed and absorbed by the arc edge 131 which forms the cutaway part 13 of the reinforcing member 10. The actuating rod 20 tends to be deformed laterally in a direction intersecting the axial line by a strong depressing force while the pushing blocks 40 and 40' are applying a depressing force to the neck part 51. Such deformation is eliminated by the hard block 60 serving as a separator.

The stress concentration effect of concave warp of the neck part 51 is the same as in the case that the neck part 51 is warped to be convex relative to the strings 54, as shown by broken lines in FIG. 7. In such case, as shown in FIG. 8, the pushing-down surface 42 of the pushing block 40 directly pushes the bottom 521 of the groove 52 and the pushing force is concentrated at such location onto this portion. The reinforcing member 10 and the actuating rod 20 operate together in the groove 52, and therefore the reinforcing member 10 and the actuating rod 20 are curved so that the extreme end parts thereof are repulsed opposite to the convex warp of the neck part 51, as shown in FIG. 8. A repulsive force produced from such curving is concentratedly applied to the bottom 521 of the groove 52 by the pushing block 40, whereby the neck part 51 is straightened.

The neck straightener according to the present invention directly pushes the center of warp of the neck part 51 to accurately straighten the warp thereof. Such warp of the neck part 51 can be exactly straightened.

The straightener according to the present invention is provided with partly cutaway parts 13 formed by the arc-shaped edges 131 on both side walls of the reinforcing member 10. Therefore, a stress or a repulsive force to be concentrated to one point of the reinforcing member 10 is dispersed and applied along the arc-shaped edge 131. This prevents application of forces that would cause the reinforcing member 10 to be bent or folded. Simultaneously, the hard block 60, which is provided in the reinforcing member 10 to maintain a centered position of the actuating rod 20, prevents the actuating rod 20 from being deformed laterally in the channel of the reinforcing member 10 by an external force and the stress or the repulsive force which is concentrated at one point of the actuating rod 20.

What is claimed is:

1. A neck straightener for a stringed instrument, said straightener comprising:

a reinforcing member with a U-shaped section and made of a resilient material having a high degree of rigidity;

an actuating rod made of a resilient material having a high degree of rigidity, said rod including an extreme end part joined with an end of said reinforcing member and accommodated therein in parallel therewith;

means for fixing a base end of said reinforcing member in an elongate groove of a neck part of the stringed instrument;

adjusting means provided at a base end of said actuating rod to increase and decrease the length thereof relative to said reinforcing member;

at least one pushing block provided on said actuating rod at a location thereon to correspond to a center of warp of the neck part, said pushing block having a first pushing surface coming into contact with an internal surface of said reinforcing member; and a partly cutaway part formed at each of opposite sides of said reinforcing member, each said partly cutaway part being formed to have a length to be aligned with said pushing block, and an edge of each said partly cutaway part being formed as a continuously arc-shaped edge.

2. A neck straightener for a stringed instrument according to claim 1, wherein said first pushing surface of said pushing block is provided at a position where said first pushing surface pushes up said reinforcing member at a position corresponding to the center of warp when the neck part is to be warped to be concave relative to strings of the stringed instrument.

3. A neck straightener for a stringed instrument according to claim 1, wherein said pushing block has a second pushing surface located at a position opposite said first pushing surface and operable to push down a bottom of the elongate groove of the neck part at a position approximately corresponding to the center of warp when the neck part is to be warped to be convex relative to strings of the stringed instrument.

4. A neck straightener for a stringed instrument according to claim 1, wherein said reinforcing member is to be accommodated in the neck part while being kept in contact with a bottom of the elongate groove of the neck part, and said pushing block is arranged so that said first pushing surface thereof comes into contact with said internal surface of said reinforcing member at a position corresponding to the center of warp when the neck part is warped to be convex relative to strings of the stringed instrument.

5. A neck straightener for a stringed instrument according to claim 1, comprising two pushing blocks arranged in parallel on said actuating rod, one of said pushing blocks having said first pushing surface coming into contact with said internal surface of said reinforcing member and the other of said pushing blocks having a second pushing surface which faces away from said internal surface of said reinforcing member.

6. A neck straightener for a stringed instrument according to claim 1, wherein a hard block is arranged between said reinforcing member and said actuating rod and is accommodated in a channel of said reinforcing member to maintain the axial position of said actuating rod to be spaced between side walls of said reinforcing member.

7. A neck straightener for a stringed instrument according to claim 1, wherein said end of said reinforcing member joined with said extreme end part of said actuating rod comprises an extended protrusion part that is folded back to an external surface side of said actuating rod to hold said actuating rod by and between an extreme end part and said protrusion part of said reinforcing member, and said protrusion part is welded to said extreme end parts of said actuating rod and said reinforcing member.

8. A neck straightener for a stringed instrument according to claim 7, wherein said protrusion part is spot welded to said extreme end parts of said actuating rod and said reinforcing member.

9. A neck straightener for a stringed instrument according to claim 8, wherein said protrusion part is spot welded to said extreme end parts of said actuating rod and said reinforcing member after fixing thereof with a pin passing through said extreme end parts of said actuating rod and said reinforcing member and through said protrusion part.

* * * * *